US007489978B2

(12) United States Patent
Suyama et al.

(10) Patent No.: US 7,489,978 B2
(45) Date of Patent: Feb. 10, 2009

(54) DIGITAL AUDIO MIXER WITH PREVIEW OF CONFIGURATION PATTERNS

(75) Inventors: Akio Suyama, Hamamatsu (JP); Kotaro Terada, Hamamatsu (JP); Taku Nishikori, Hamamatsu (JP); Takamitsu Aoki, Hamamatsu (JP); Masaru Aiso, Hamamatsu (JP); Kei Nakayama, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 629 days.

(21) Appl. No.: 10/124,156

(22) Filed: Apr. 16, 2002

(65) Prior Publication Data

US 2002/0156547 A1 Oct. 24, 2002

(30) Foreign Application Priority Data

Apr. 23, 2001 (JP) ..... 2001-123867
Apr. 23, 2001 (JP) ..... 2001-123868
Apr. 23, 2001 (JP) ..... 2001-123869

(51) Int. Cl.
*G06F 17/00* (2006.01)
*H04B 1/00* (2006.01)

(52) U.S. Cl. ..... 700/94; 381/119

(58) Field of Classification Search ..... 700/94; 381/119

See application file for complete search history.

(56) References Cited

U.S. PATENT DOCUMENTS 4,503,471 A * 3/1985 Hanajima et al. ..... 360/69
5,060,272 A * 10/1991 Suzuki ..... 381/119
5,402,501 A * 3/1995 Silfvajt et al. ..... 381/119

FOREIGN PATENT DOCUMENTS

JP 5282247 10/1993
JP 6110639 4/1994

(Continued)

OTHER PUBLICATIONS

Roland Corporation, "24-bit Digital Studio Workstation VS-1680 Owner's Manual", copyright 1998, pp. 12-17, 31-57.*

(Continued)

*Primary Examiner*—Suhan Ni
*Assistant Examiner*—Daniel R Sellers
(74) *Attorney, Agent, or Firm*—Morrison & Foerster LLP

(57) ABSTRACT

A digital mixer has a panel and a mixing processor configurable in matching with a scene to mix audio signals fed from input channels and to feed the mixed audio signals to output channels. The panel has an operator manipulable to operate the mixing processor, and a display provided for displaying a state of the mixing processor. Further, a storage is provided for storing configuration patterns of the mixing processor in correspondence to various scenes. A retriever is provided for calling one of the various scenes and for retrieving the configuration pattern corresponding to the called scene from the storage; a selector provided for selecting one of a preview mode and a non-preview mode. A controller operates when the non-preview mode is selected for actually configuring the mixing processor according to the retrieved configuration pattern to thereby enable the mixing processor to reproduce the corresponding scene, and operates when the preview mode is selected for producing a preview of a configured state of the mixing processor according to the retrieved configuration pattern without actually configuring the mixing processor to thereby enable the display to present the preview.

6 Claims, 14 Drawing Sheets

FOREIGN PATENT DOCUMENTS

| | | |
|---|---|---|
| JP | 07-015789 | 1/1995 |
| JP | 07-122944 | 5/1995 |
| JP | 928427 | 11/1997 |

OTHER PUBLICATIONS

Roland Corporation, "VM-C7200/C7100 Owner's Manual", copyright 1999, pp. 1-61, 232-247.*
Roland Corporation, "VM-C7200/C7100 Owner's Manual", copyright 1999, pp. 1, 62-231, and 248-312.*
Roland Corporation, "Basics of Mixing", copyright 1999, cover page and pp. 1-65.*
Yamaha 03D Digital Mixing Console Owner's Manual, pp. 163-173, 2000.
Let's Use CSV, Hiroyuki Hanai, Sep. 1, 2000.
Yamaha Digital Mixer [02R/03D/01V], Seiichi Miyawaki, Feb. 1, 1999.
Electronic Musician, vol. 13, No. 11, pp. 144-153 (Nov. 1997).

* cited by examiner

DIGITAL AUDIO MIXER WITH PREVIEW OF CONFIGURATION PATTERNS

BACKGROUND OF THE INVENTION

The present invention relates to a digital mixer for centralized control of an audio system situated at places where concerts, plays and the like are performed.

Conventionally, a mixer for controlling an audio system at concerts or theaters is known. In the audio system at these places, many microphones and speakers are used, and various sound effects are also applied. For example, the mixer controls in a centralized manner to configure how a lot of inputs are mixed, how effects are applied to the inputs, and how the mixed and/or effect-applied results are distributed to an output system. Therefore, some conventional mixers can memorize a configured pattern including a mixing state and connection state of inputs and outputs as a "scene". Memorizing the set state as a scene can facilitate restoration of the set state in later by recalling the memorized scene.

To recall a scene, for example, a method is used in which a scene number is incremented/decremented sequentially with an INC/DEC switch so that scene data (configuration pattern) corresponding to the incremented/decremented scene number will be recalled. Another method is also known in which a specific scene number is entered using a numeric keypad so that a scene corresponding to the number will be directly recalled.

Further, a number of changes or switching in various scene settings are frequently made, hence some conventional mixers also have an UNDO feature for restoring the past settings.

The conventional mixers, however, cannot review details of another scene (e.g. next scene) other than a currently selected scene while maintaining the active state of the currently set scene. In many cases, the settings of another scene such as the next scene needs to be reviewed when another scene is to be introduced in a concert, play or the like. It is also impossible to change the set state of any other scenes while maintaining the set state of the current scene.

Scene data of all consecutive scene numbers are not always stored, and some scene data may be missing or deleted in the conventional mixer. However, the scene numbers are incremented or decremented on a one-by-one basis for calling a target scene. The operator has to page through all scenes including those of scene numbers lacking substantial scene data, which makes data manipulations very complicated.

Many scenes of different situations are stored in a scene memory. In a sequence of plural scenes for a music event such as a concert or play for which the mixer is used, easy recall of a specific scene at a break of the music event could be required. However, as mentioned above, the operator has to operate the "INC/DEC" switch many times to reach a desired scene at some midpoint in the sequence of the scenes. Otherwise, the operator needs to directly enter a scene number of the desired scene on the numeric keypad. However, the scene number is not readily available in often cases.

In the conventional mixers, scene data include all and detailed settings of the scene. Since the scene data may contain rarely changed data on each scene at a concert or play, the conventional mixers are inefficient in terms of memory capacity and response. Some data do not need to be changed on a scene basis and may be used commonly for different scenes.

Further, when scene data are edited or created while changing various settings, the undo function may be occasionally be used to restore the past setting. However, when the current setting of a scene with a specific scene number is to be moved back to the past setting, setting process for another scene may intervene occasionally. In such a case, the conventional mixers have no way of knowing how many UNDOs are needed to restore the past setting of the target scene number.

SUMMARY OF THE INVENTION

The present invention has been made in consideration of the above conventional problems, and it is a first object thereof to provide a digital mixer capable of previewing another scene or changing the setting of another scene while keeping the active state of a scene currently selected.

It is a second object of the invention to provide a digital mixer, which can eliminate such complicated data manipulations that when recalling a scene with an INC/DEC switch, an operator will have to page through all scenes including those of scene numbers lacking substantial scene data, and which can also respond to demands for easy recall of a specific scene at a break of a music event.

It is a third object of the invention to provide a digital mixer which has a scene data structure capable of reducing memory capacity required for storing scene data and improving response efficiency, and to provide a digital mixer capable of responding demands for restoring the past setting of a scene with a desired scene number.

In a first aspect of the invention, a digital mixer comprises: a mixing processor configurable in matching with a scene to mix audio signals fed from input channels and to feed the mixed audio signals to output channels; a panel having an operator manipulable to operate the mixing processor and a display provided for displaying a state of the mixing processor; a storage provided for storing configuration patterns of the mixing processor in correspondence to various scenes; a retriever provided for calling one of the various scenes and for retrieving the configuration pattern corresponding to the called scene from the storage; a selector provided for selecting one of a preview mode and a non-preview mode; and a controller being operative when the non-preview mode is selected for actually configuring the mixing processor according to the retrieved configuration pattern to thereby enable the mixing processor to reproduce the corresponding scene, and being operative when the preview mode is selected for producing a preview of a configured state of the mixing processor according to the retrieved configuration pattern without actually configuring the mixing processor to thereby enable the display to present the preview.

Preferably, the digital mixer further comprises an editor operative when the preview mode is selected for editing the preview of the configured state of the mixing processor by means of the operator to create a new configuration pattern in correspondence to a new scene, and for storing the created new configuration pattern in the storage.

Preferably, the digital mixer further comprises a restoring section operative when a non-preview mode is again selected after a previous non-preview mode is once switched to a preview mode, for restoring the configured state of the mixing processor held in the previous non-preview mode.

Another inventive digital mixer comprises: a mixing processor configurable in matching with a scene to mix audio signals fed from input channels and to feed the mixed audio signals to output channels; a panel having an operator manipulable to operate the mixing processor and a display provided for displaying a state of the mixing processor; a viewer provided for producing a view of a configured state of the mixing processor; a storage provided for storing configuration patterns of the mixing processor in correspondence to various scenes; a retriever provided for calling one of the various scenes and for retrieving the configuration pattern corresponding to the called scene from the storage so as to configure the mixing processor based on the retrieved configuration pattern and to allow the viewer to produce the view of the configured state of the mixing processor based on the retrieved configuration pattern; a selector provided for selecting one of a preview mode and a non-preview mode; and a controller being operative when the non-preview mode is selected for enabling the configuring of the mixing processor based on the retrieved configuration pattern to effectuate mixing of the audio signal and for enabling the viewer to present the produced view of the configured state of the mixing processor on the display, and being operative when the preview mode is selected for enabling the viewer alone and disabling the configuration of the mixing processor.

In a second aspect of the invention, a digital mixer comprises: a mixing processor configurable in matching with a scene to mix audio signals fed from input channels and to feed the mixed audio signals to output channels; a storage provided for storing data of configuration patterns of the mixing processor in correspondence to respective scenes, the configuration patterns being associated with sequential numbers corresponding to the respective scenes, data of each configuration pattern containing a flag indicating whether the configuration pattern is blank or not; an operator panel including a switch operable to successively increment or decrement the sequential numbers to call one scene as desired; a retriever that retrieves data of the configuration pattern corresponding to the called scene from the storage so that the mixing processor can be configured according to the retrieved configuration pattern to produce the corresponding scene; and a controller operative during the course of operating the switch for skipping any sequential number if the associated configuration pattern is indicated blank by the flag while the remaining sequential numbers are successively incremented or decremented.

Preferably, the storage stores the data of the configuration pattern containing a current version and one or more past version, such that the past version may be reserved even though the configuration pattern is made blank.

Another inventive digital mixer comprises: a mixing processor configurable in matching with a scene for mixing audio signals fed from the input channels and feeding the mixed audio signals to output channels; a storage provided for storing configuration patterns of the mixing processor in correspondence to respective scenes; an operator panel including a sequential switch operable for sequentially scanning the respective scenes to designate one of the scenes as desired, and a direct switch operable for directly designating one of the scenes as preset; an allocator provided for allocating at least one of the scenes to the direct switch as the preset scene; a retriever that retrieves the configuration pattern corresponding to the designated scene from the storage; and a controller provided for configuring the mixing processor according to the retrieved configuration pattern to thereby reproduce the designated scene.

In a third aspect of the invention, a digital mixer comprises: a mixing circuitry configurable based on configuration data in matching with a scene for mixing audio signals fed from input channels and feeding the mixed audio signals to output channels; a storage provided for storing a plurality of configuration data in correspondence to a plurality of scenes, the configuration data containing first layer data directly associated to the corresponding scene and second layer data identified by link information embedded in the first layer data; an operator panel operable for calling one of the scenes as desired; and a retriever that retrieves the configuration data corresponding to the called scene from the storage and that configurates the mixing circuitry based on the retrieved configuration data to reproduce the corresponding scene, wherein the retriever operates when the operator panel calls a next scene in place of a current scene reproduced currently by the mixing circuitry for reconfigurating the mixing circuitry based on the first layer data of the configuration data corresponding to the next scene, and further the retriever operates only if the link information embedded in the configuration data of the next scene differs from the link information embedded in the configuration data of the current scene for reconfiguring the mixing circuitry additionally based on the second layer data identified by the link information embedded in the configuration data of the next scene.

Preferably, the storage stores the configuration data having the first layer data effective to configurate at least one of the input channels, the output channels, an effector integrated in the mixing circuitry for applying an effect to the audio signals, and an equalizer integrated in the mixing circuitry for equalizing the audio signals.

Preferably, the storage stores the second layer data of the configuration data, including at least one of patch data for determining connections between the input channels and the output channels, name data indicating correspondence between respective channels including the input channels and the output channels and respective names assigned to the respective channels, and unit data for configuring either of an input board connected to the input channel and an output board connected to the output channels.

Another digital mixer comprises: a mixing circuitry configurable based on a configuration pattern in matching with a scene for mixing audio signals fed from input channels and feeding the mixed audio signals to output channels; a storage provided for storing data of configuration patterns in correspondence to respective scenes, the data containing not only a current version of the configuration pattern but also one or more past version of the same configuration pattern; an operator panel operable for calling one of the scenes as desired; and a retriever that retrieves the data of the configuration pattern corresponding to the called scene from the storage and that configurates the mixing circuitry normally based on the current version of the retrieved configuration pattern.

Preferably, the operator panel can specify one of the past versions of the configuration pattern corresponding to the called scene, such that the retriever can retrieve the data of the specified past version and may restore the mixing circuitry based on the specified past version of the configuration pattern.

Preferably, the storage stores the configuration patterns in association with identification codes, each being comprised of a main code and a sub code such that the current version of the configuration pattern is identified by the main code corresponding to the scene and the past version of the same configuration pattern is identified by the sub code, and wherein the retriever operates when the operator panel inputs only the main code for retrieving the current version of the configuration pattern identified by the inputted main code, and operates when the operator panel inputs the sub code together with the main code for retrieving the past version identified by the inputted sub code from the configuration pattern identified by the inputted main code. For instance, the identification code comprises a number having an integer part defining the main code and a decimal part defining the sub code.

DETAILED DESCRIPTION OF THE EMBODIMENTS

The following will describe an embodiment with reference to the accompanying drawings.

Figure 1:
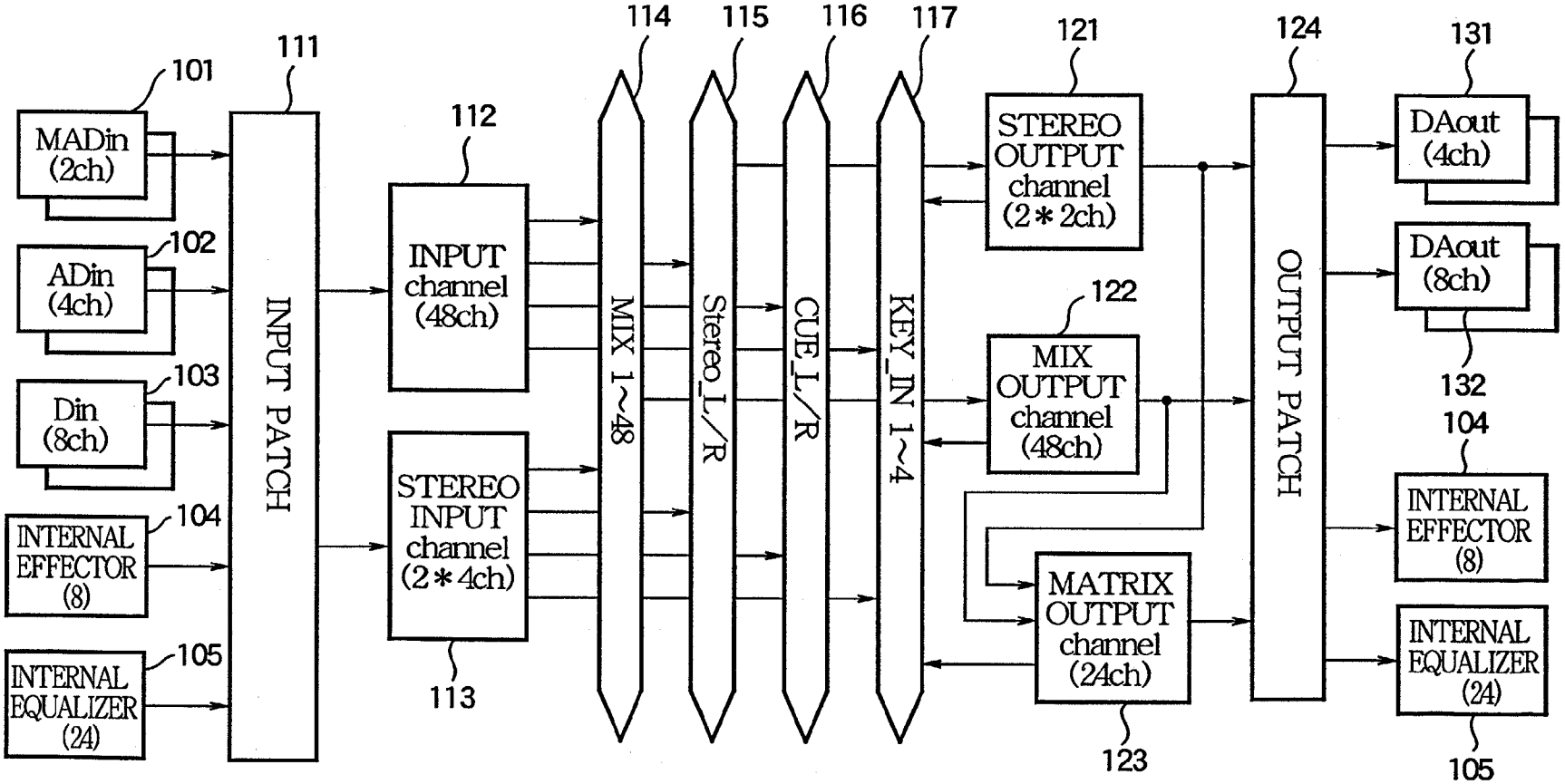
FIG. 1 is a functional block diagram showing a configuration of a digital mixer according to an embodiment of the invention.

FIG. 1 shows a functional configuration of a digital mixer according to an embodiment of the present invention. The reference numerals 101 to 105 designate inputs to mixing processing blocks. The MADin 101 indicates an input via an analog-to-digital conversion input board for microphone signals. One board of this type can receive two-channel inputs. The ADin 102 indicates an input via an analog-to-digital conversion input board for line signals. One board of this type can receive four-channel inputs. The Din 103 indicates an input via a digital input board. One board can receive eight-channel digital inputs (by using two lines). Of this type The three kinds of boards, the MADin 101, the Adin 102 and the Din 103, are each expandable up to eighty boards. Each board can be inserted and added in an interface box. Here, ten boxes, each of which can hold up to eight boards, are connectable. At the maximum, four inputs by eighty boards will be in total 320 inputs.

An internal effector 104 indicates inputs from eight effectors incorporated in the digital mixer. Each of the eight effectors takes in a stereo signal, gives selected effects, and outputs the effect-given stereo signal. An internal equalizer 105 indicates inputs from 24 equalizers incorporated in the digital mixer. Each of the 24 equalizers takes in a single signal, perform equalizer processing and output the processed single signal. The term "single" indicates a single channel, not stereo.

An input patch 111 establishes a desired connection from the maximum of 320 single inputs (MADin 101, Adin 102, Din 103), the internal effector outputs (eight stereo outputs) and the internal equalizer outputs (24 single outputs) to an input channel (48 single inputs) and to stereo input channels (four stereo inputs). Users can arbitrarily change the settings while previewing a predetermined screen.

An input signal selected at the input patch 111 is inputted to an input channel 112. In the same way, another input signal selected at the input patch 111 is inputted to a stereo-input channel 113. The input channel 112 and the stereo input channel 113 have a structure shown in FIG. 2(*a*) as will be described later. The difference therebetween is that a left signal (L) and a right signal (R) of the stereo on the stereo input channel 113 are controlled in pairs. From the input channel 112, any signal can be selectively outputted to any channel of a 48 MIX bus 114 or a stereo bus (Stereo_L/R) 115. In the same way, any signal can be selectively outputted from the stereo input channel 113 to any channel of the MIX bus 114 or the stereo bus 115. Each transmission level to the MIX bus 114 and the stereo bus 115 can be set independently in the input channel 112 and the stereo input channel 113. Also, any signal can be selectively outputted from the input channel 112 or the stereo input channel 113 to a CUE_L/R bus 116 and a KEY_IN bus 117 as will be described later.

The MIX bus 114 mixes signals inputted from the input channel 112 and the stereo input channel 113. The mixed signal is outputted to a corresponding MIX output channel 122. Each channel of the MIX bus 114 corresponds to one of the MIX output channel 122 on a one-to-one basis. The stereo bus 115 mixes signals inputted from the input channel 112 and the stereo input channel 113. The mixed stereo signals are outputted to two channels of a stereo output channel 121 concurrently. The CUE_L/R bus 116 is to check what signal is inputted in each channel. As will be described later, a CUE button is provided below each channel operator and when it is turned on, only the signal of the channel passes through the bus 116 and can be checked confirmed, for example, with a head phone and the like. The KEY_IN bus 117 is a four-channel single input bus and controls a compressor.

In the stereo output channel 121, L and R components of the stereo are controlled in pairs at all times. An output of the stereo output channel 121 is outputted to an output patch 124 and a matrix output channel 123. The MIX output channel 122 sends outputs from the MIX bus 114 to the output patch 124 or the matrix output channel 123. In the MIX output channel 122, the (2N+1)th channel and the (2N+2)th channel can be paired with each other.

The matrix output channel 123 can selectively input any number of signals from the stereo output channel 121 and the MIX output channel 122, and furthermore, the matrix output channel 123 can mix the signals inputted, selectively. The structure of the signal processing of the matrix output channel 123 is the same as that of the stereo output channel 121 and the MIX output channel 122. An output of the matrix output channel 123 is fed to the output patch 124.

The output patch 124 establishes a desired connection from the above-mentioned three kinds of output channels (72 single outputs and two stereo outputs) to a maximum of 192 single outputs (DAout, Dout), the internal effector (eight stereo inputs), or the internal equalizer (24 single inputs). A DAout 131 indicates an output to a digital-to-analog conversion output board. One board of this type can receive four-channel inputs. A Dout 132 indicates an output to a digital output board. One board of this type can receive eight-channel outputs (by using two lines). An output from the output patch 124 can also be outputted to the internal effector 104 or the internal equalizer 105.

To simplify the diagram, inputs of a console side and other inputs such as talk-back in, outputs of the console side and other outputs such as cue out, and connections for insert effects and a monitor output are omitted.

Figure 2:
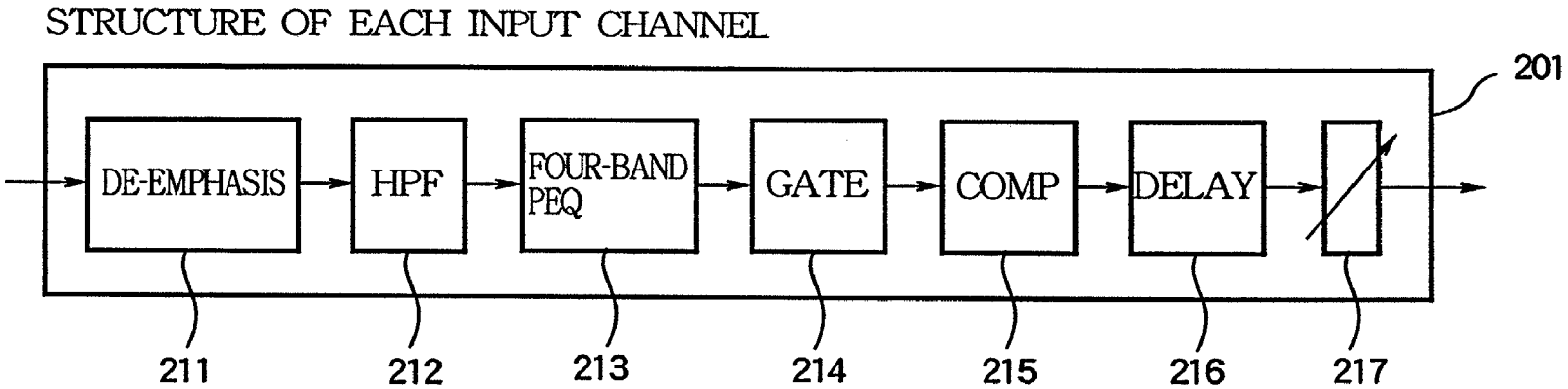
FIGS. 2(*a*) and 2(*b*) are a diagram showing the structure of input and output channels in the embodiment.
Figure 2:
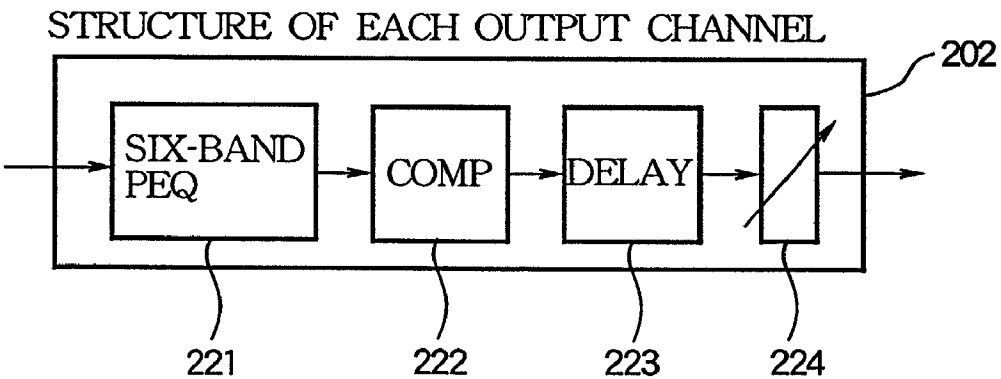

FIG. 2(*a*) shows the structure of one channel of the input channel device 112 of FIG. 1. An input channel 201 is provided with a de-emphasis 211, a high-pass filter (HPF) 212, a four-band PEQ (programmable equalizer) 213, a noise gate 214, a compressor 215, a delay circuit 216, and a fader 217. The de-emphasis 211 is a filter to regulate frequency characteristics.

The noise gate is a gate to close (cut off a signal line) when a signal level goes down so that noise will not remain. The compressor 215 is to conduct an automatic gain control. The delay circuit 216 is used for phase matching so that when plural speakers are placed at a concert hall or the like, musical sounds from respective speakers will not counteract one another. The fader 212 is a volume for level control. The structure of the stereo input channel 113 is basically the same as that in FIG. 2(*a*). A different point is that in the stereo input channel 113, the left signal (L) and the right signal (R) of the stereo are controlled in pairs.

FIG. 2(*b*) shows the structure of one output channel of the MIX output channel device 122 of FIG. 1. An output channel 202 is provided with a six-band PEQ 221, a compressor 222, a delay circuit 223, and a fader 224. The stereo output channel 121 and the matrix output channel 123 basically are of the same structure as that in FIG. 2(*b*). A different point is that in the stereo input channel 121, the left signal (L) and the right signal (R) of the stereo are controlled in pairs. As for the matrix output channel, a mixing part is provided before the six-band PEQ for selectively mixing one or more signals from channels being set as input sources of the matrix output channel of the stereo output channel and the MIX output channel.

Figure 3:
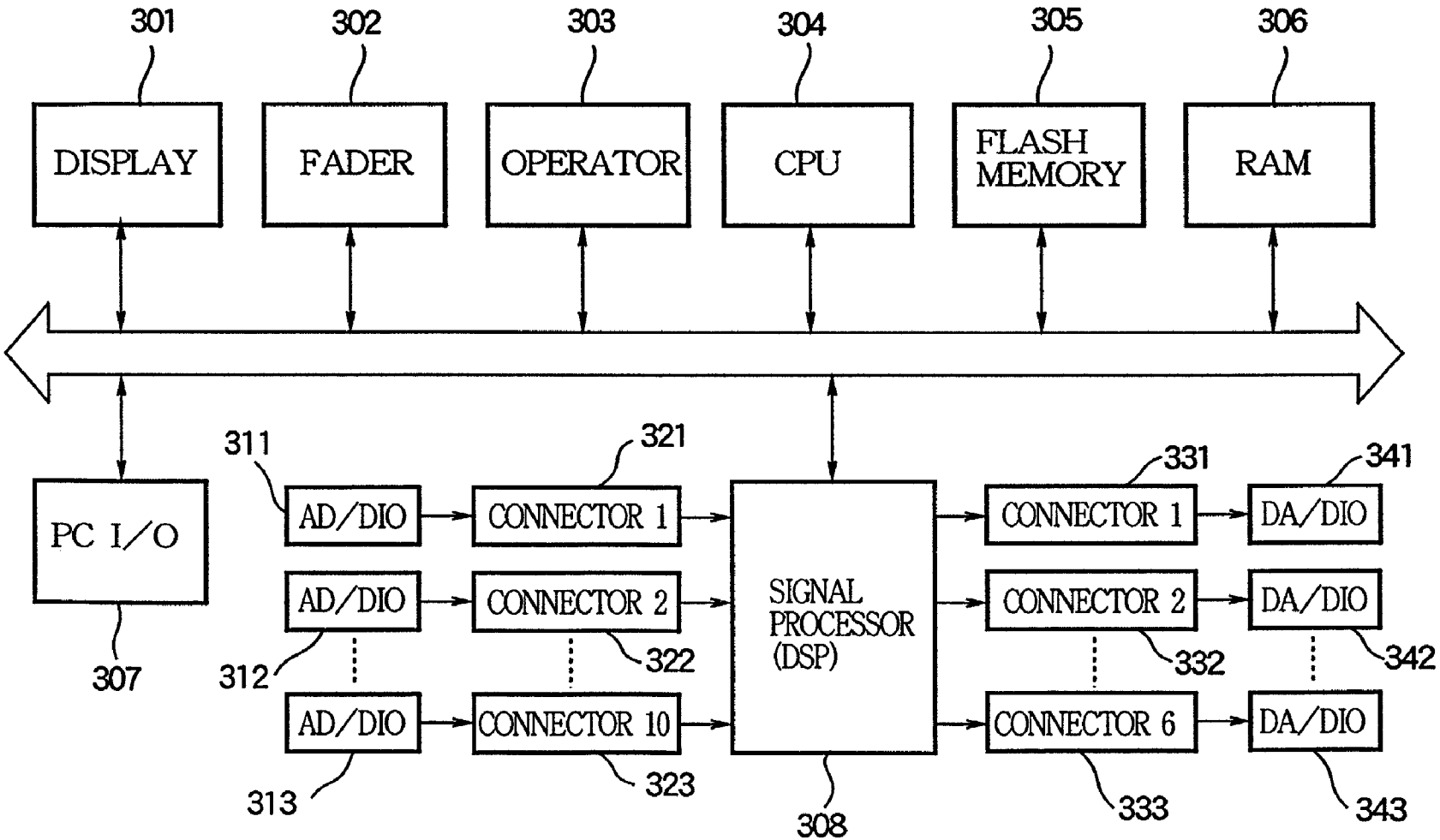
FIG. 3 is a block diagram showing a hardware configuration of the digital mixer according to the embodiment.

FIG. 3 shows a hardware block diagram of a digital mixer according to the present invention. The digital mixer includes a display 301, a fader 302, an operator 303, a central processing unit (CPU) 304, a flash memory 305, a random access memory (RAM) 306, a PC input/output interface 307, and a digital signal processor (DSP) 308. The display 301, the fader 302, and the operator 303 are provided on a panel of the digital mixer so that users can monitor to and operate them. An operation program executed by the CPU 304 is stored in the flash memory 305. Various data to be described later using FIG. 1 are also stored in the flash memory 305. The CPU 304 detects operations of the operator 303 and the fader 302, and controls the operation of the DSP 308, display contents of the display 301, and the position of the fader 302. The fader 302 is a so-called moving fader with a motor. The CPU 304 can detect the position of the fader 302 and move the fader 302 to a specified position in response to an instruction from the CPU 304.

The DSP (digital signal processor) 308 is designed for performing the mixer processing as shown in the functional configuration of FIG. 1. The DSP 308 is provided with connectors 1-10 (321-323) on the input side and connectors 1-6 (331~333) on the output side for input and output of signals. Each of input connectors 321-323 can be connected to either an analog/digital conversion box or a digital interface box as the interface box described in FIG. 1. In one analog/digital conversion box, up to eight A/D conversion boards (the MADin101 in FIG. 1) are expandable. The gain (volume) and polarity can be set for each analog-to-digital conversion input. In one digital interface box, up to eight digital I/O boards (the Din 103 and the Dout132 in FIG. 1) are expandable.

Also, one of input connectors 331-333 on the output side of the DSP 308 can be connected to either a digital/analog conversion box or a digital interface box as the interface box described in FIG. 1. In one digital/analog conversion box, up to eight D/A conversion boards (the DAout 131 in FIG. 1) are expandable. The gain and polarity can be set for each digital/analog conversion output. The digital I/O board to be inserted into the digital interface box may be commonly used for input and output. In this case, the digital interface box is commonly used on both the input and output sides of the DSP 308.

Figure 4:
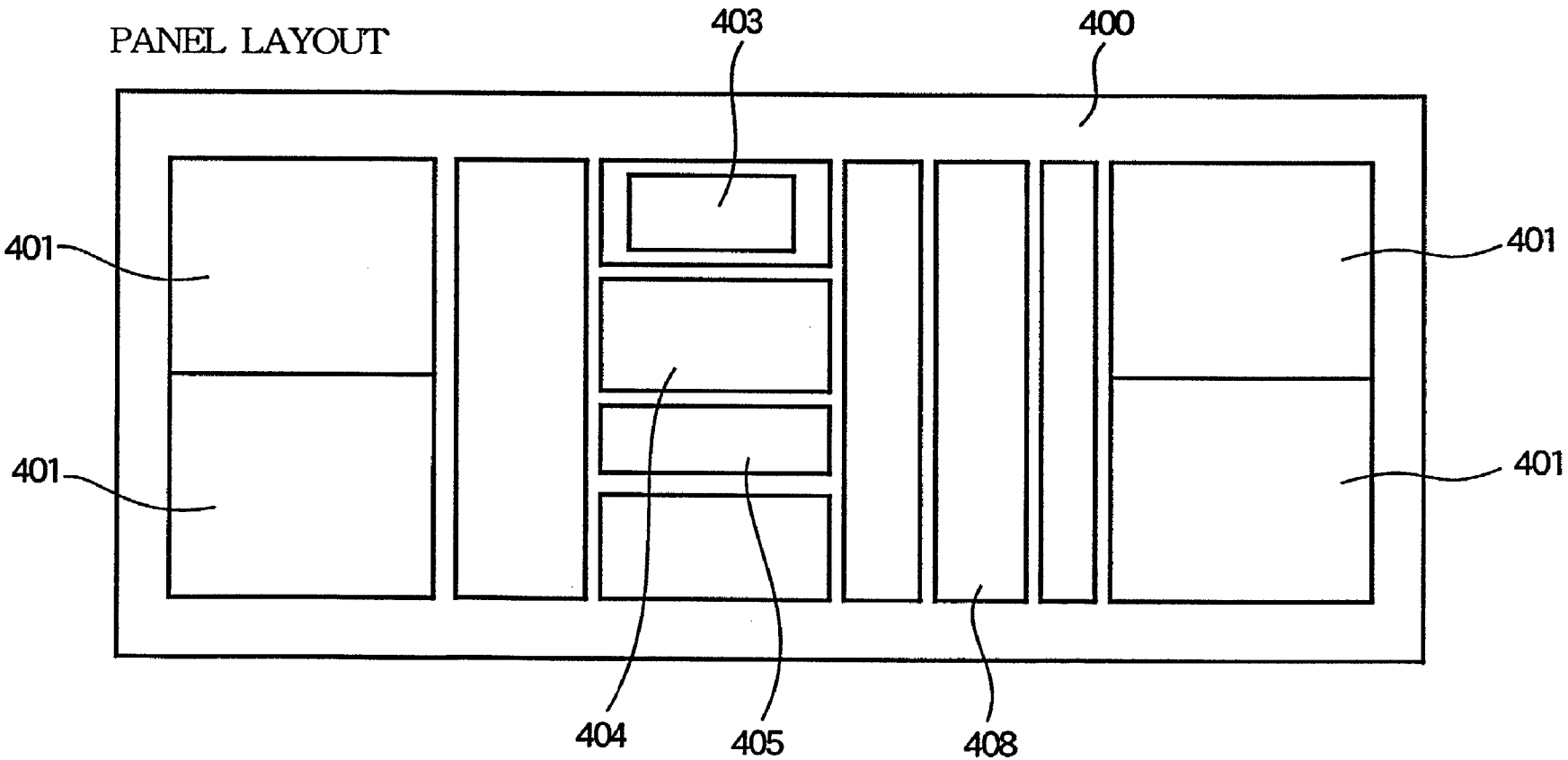
FIG. 4 is a diagram showing a layout of an operation panel of the digital mixer according to the embodiment.

FIG. 4 shows an arrangement of an external panel of the digital mixer according to the embodiment. The display, various kinds of operators and the like are divided into respective sections and arranged on a panel 400. The reference numeral 401 designates an input channel section, 403 is a display section, 404 is a matrix channel section, 405 is a MIX channel section, and 408 is a control/memory section.

The following will describe each section of the panel in detail.

Figure 5:
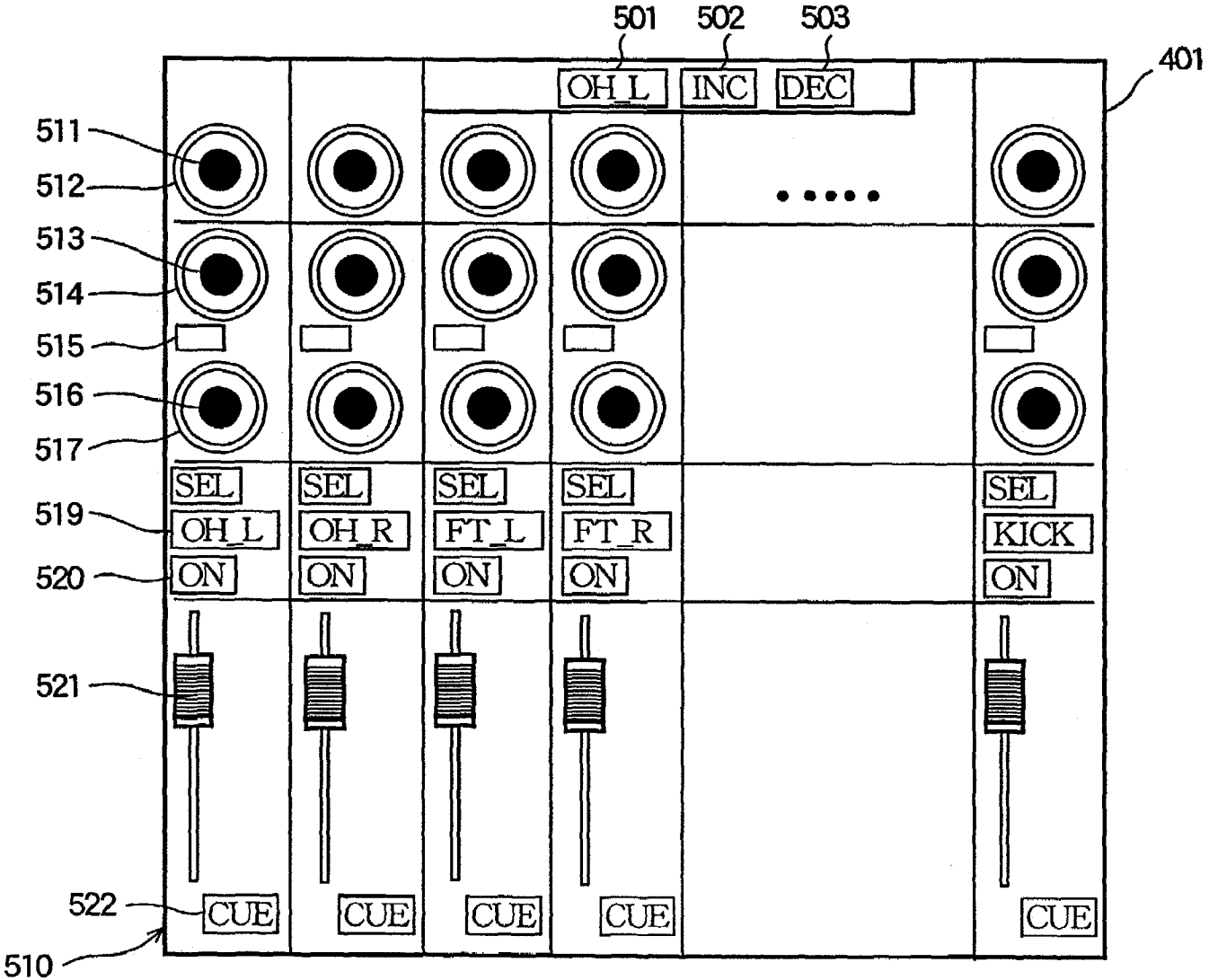
FIG. 5 is a diagram showing a detailed configuration of an input channel section of the operation panel.

FIG. 5 shows a detailed configuration of the input channel section 401. The input channel section 401 is apart for setting the gain and the like of each input channel in FIG. 1. A vertically oriented longitudinal part 510 indicates one set of operators corresponding to one channel, and several sets of operator groups arranged constitute the input channel section 401. The operator group 510 for one channel includes a controller (rotary encoder) 511 for setting the send level of a signal to a selected system of the MIX BUS 114, a controller 513 for setting a pan in sending a signal to the stereo bus 115, a switch 515 for setting On/Off of an assign to the stereo bus 115, a controller 516 for gain adjustment of a head amplifier, a display part 519 for displaying a short name assigned to the input channel, a switch 520 for setting On/Off of the input channel, a moving fader 521 with a motor for gain adjustment, and a CUE switch 522 for making the setting to send the signal of the input channel to the CUE_L/R bus 116. Around the controllers 511, 513 and 516, LED indicators 512, 514, 517 are provided to indicate the levels of the controller settings, respectively. An INC key 502 and a DEC key 503 for selecting one channel of the MIX bus whose send level corresponds to the send level of the controller 511, and a display part 501 for displaying a short name assigned to the selected MIX bus are provided in the top portion of the controller 511 of the input channel section 401.

Figure 8:
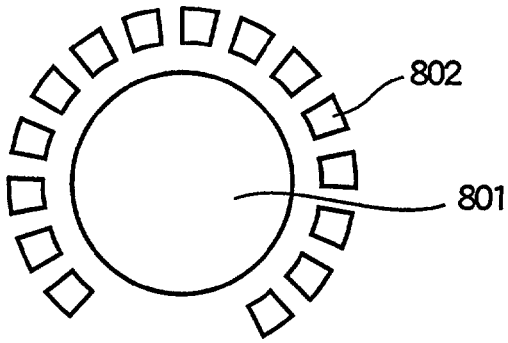
FIG. 8 is a detailed external view of a controller and an indicator of the operation panel.

FIG. 8 shows a detailed external view of a controller and an indicator. The reference numeral 801 designates a user-operated control of the controller. The reference numeral 802 designates an LED arranged around the control 801. The LED 802 is an indicator for indicating a value set by the controller 801.

Figure 6:
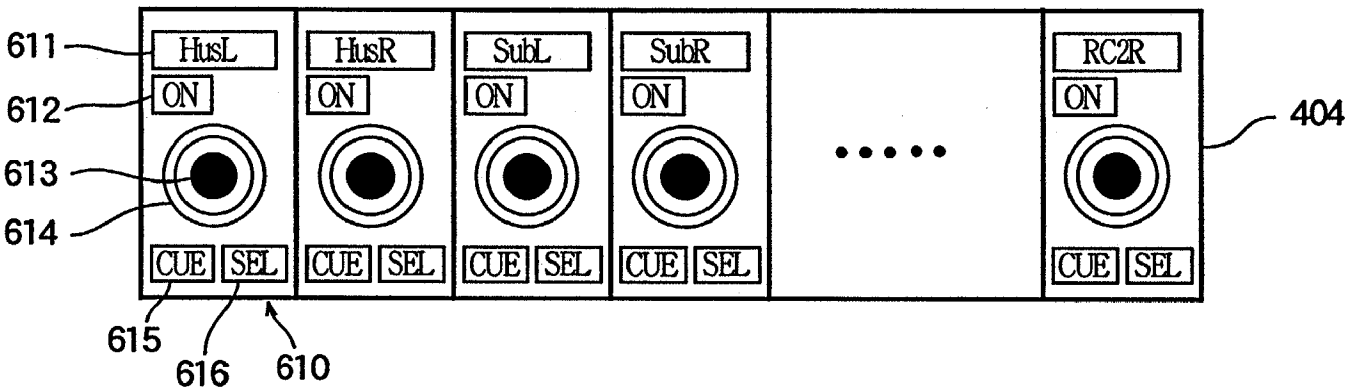
FIGS. 6(*a*) and 6(*b*) are a diagram showing detailed configurations of a matrix channel section and a MIX channel section of the operation panel.
Figure 6:
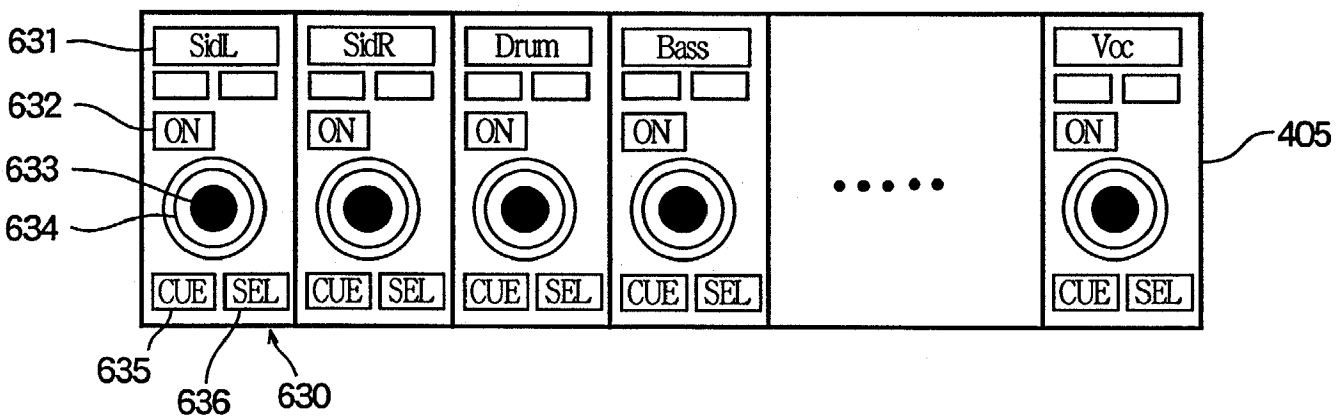

FIG. 6(*a*) shows a detailed configuration of the matrix channel section 404. The matrix channel section 404 is a part for level adjustment and the like of the matrix output channel 123 shown in FIG. 1. The reference numeral 610 designates one set of operators corresponding to one channel of the matrix output channel 123, and several sets of operator groups constitute the matrix channel section 404. The operator group 610 for one channel includes a display part 611 for displaying a short name assigned to the channel, a switch 612 for setting ON/Off of the channel, a controller 613 for setting the output level of the channel, an indicator 614 for indicating the set output level, a CUE switch 615 for making the setting to send a signal of the input channel to the CUE_L/R bus 116, and an SEL switch 616 for making several settings.

FIG. 6(*b*) shows a detailed configuration of the MIX channel section 405. The MIX channel section 405 is a part for performing level adjustment and the like of the MIX output channel 122 in FIG. 1. The reference numeral 630 designates one set of operators corresponding to one channel of the MIX output channel 122, and several sets of operator groups constitute the MIX channel section 405. The operator group 630 for one channel has the same configuration as that of the operator group 610 of the matrix channel section in FIG. 6(*a*), and portions 631-636 correspond to the portions 611-616, respectively.

Figure 7:
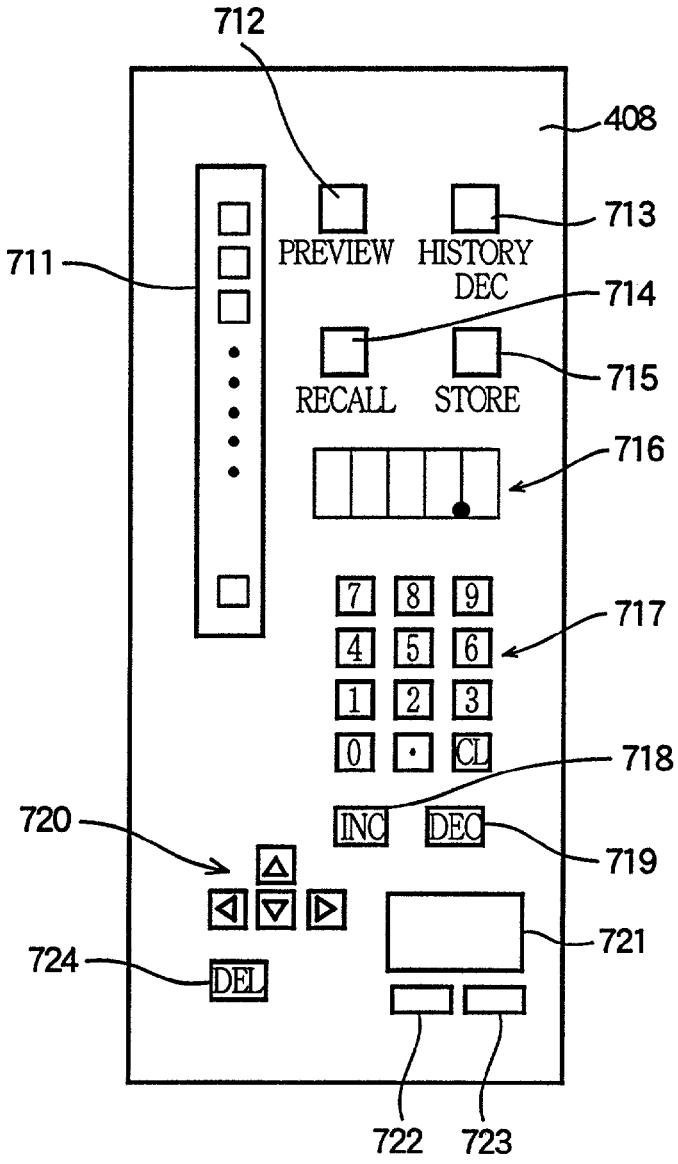
FIG. 7 is a diagram showing a detailed configuration of a control/memory section of the operation panel.

FIG. 7 shows a detailed configuration of the control/memory section 408. The control/memory section 408 includes a direct recall switch 711, a preview switch 712, a history "backward" switch 713, a recall switch 714, a store switch 715, an LED display 716, a ten-key pad 717, an INC key 718, a DEC key 719, a cursor control keypad 720, a track pad 721, a left pad switch 722, a right pad switch 723, and a delete key 724.

The direct recall key 711 is provided for one-touch recall of a scene whose scene number is assigned to each switch. The direct recall keypad 711 has twelve keys and can directly recall twelve scenes.

The preview switch 712 switches between a preview mode and a non-preview mode alternately every time the switch is operated. The non-preview mode allows the user to directly operate the current mixing state. For example, if the user operates any controller or fader in the non-preview mode, the current scene state will be changed in response to the operation. The preview mode allows the user to recall the settings of another scene so that the user can review or change (preview) the settings while maintaining the mixing state of the current active scene. Processing starting upon turning on the preview switch 712 will be described later in detail in FIG. 11.

The history "backward" switch 713 is a switch for recalling the past version of settings of each scene stored on a scene basis. Processing starting upon turning on the history "backward" switch 713 will be described later in detail in FIG. 16.

The recall switch 714 is a switch for giving an instruction to recall any scene. Recalling a scene is carried out as follows. In the preview mode, a scene number of a scene currently previewed is indicated on the display 716. Otherwise, in the non-preview mode, a scene number of a scene currently set is displayed on the LED display 716. In this state, the decimal point is fixed on the LED display 716 and the integer part indicates the scene number of a scene currently set. The fraction or decimal part indicates a past history of past version (to be described in detail later) of the scene identified by the scene number of the integer part. Here, if the user enters any scene number (integer part) on the ten-key pad 717 and turns on the recall switch 714, the latest version of the scene with the scene number concerned can be recalled. The ten-key pad 717 has a decimal point key, so that when the decimal point key is pressed after the entry of the integer part, a number below the decimal point can be entered. After that, by turning on the recall switch 714, past version data on any scene can be directly recalled.

In either the preview mode or the non-preview mode, any scene can be recalled with the INC key 718 or the DEC key 719. If the INC key 718 or the DEC key 719 is turned on when a scene number of the current scene is displayed on the LED display 716, the latest scene of the next scene number whose integer part is greater than that of the scene number of the current scene will be recalled. In this case, a blank scene may be involved, which is deleted with the delete key 724 as will be described later. When the INC key 718 is successively turned on, the blank scene is skipped and the latest scene in subsequent non-blank scenes is recalled. The DEC key 719 is operated in the same manner as the INC key 718 except that it goes in descending numeric order.

Figure 10:
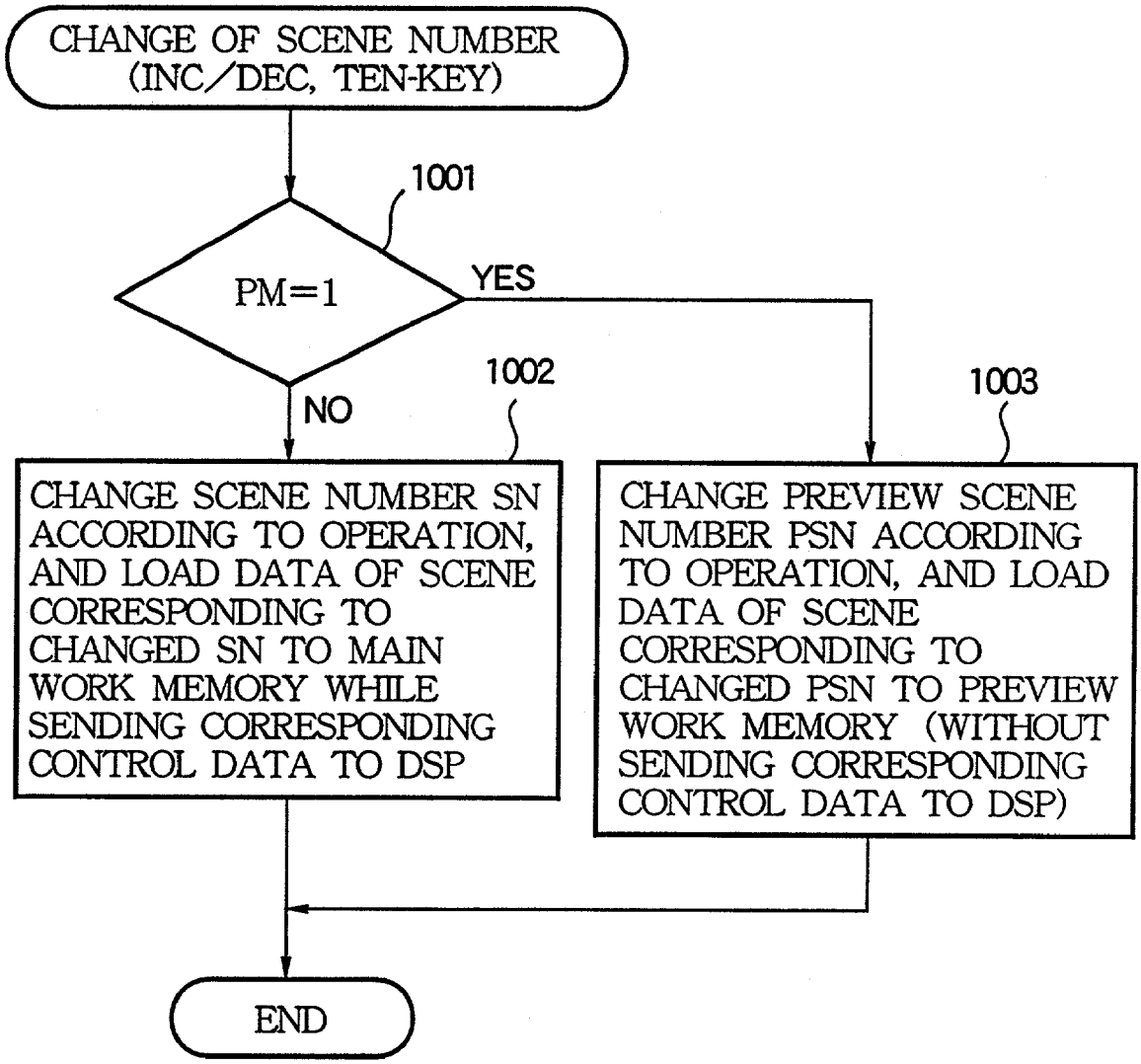
FIG. 10 is a flowchart showing a processing routine upon changing a scene number.
Figure 12:
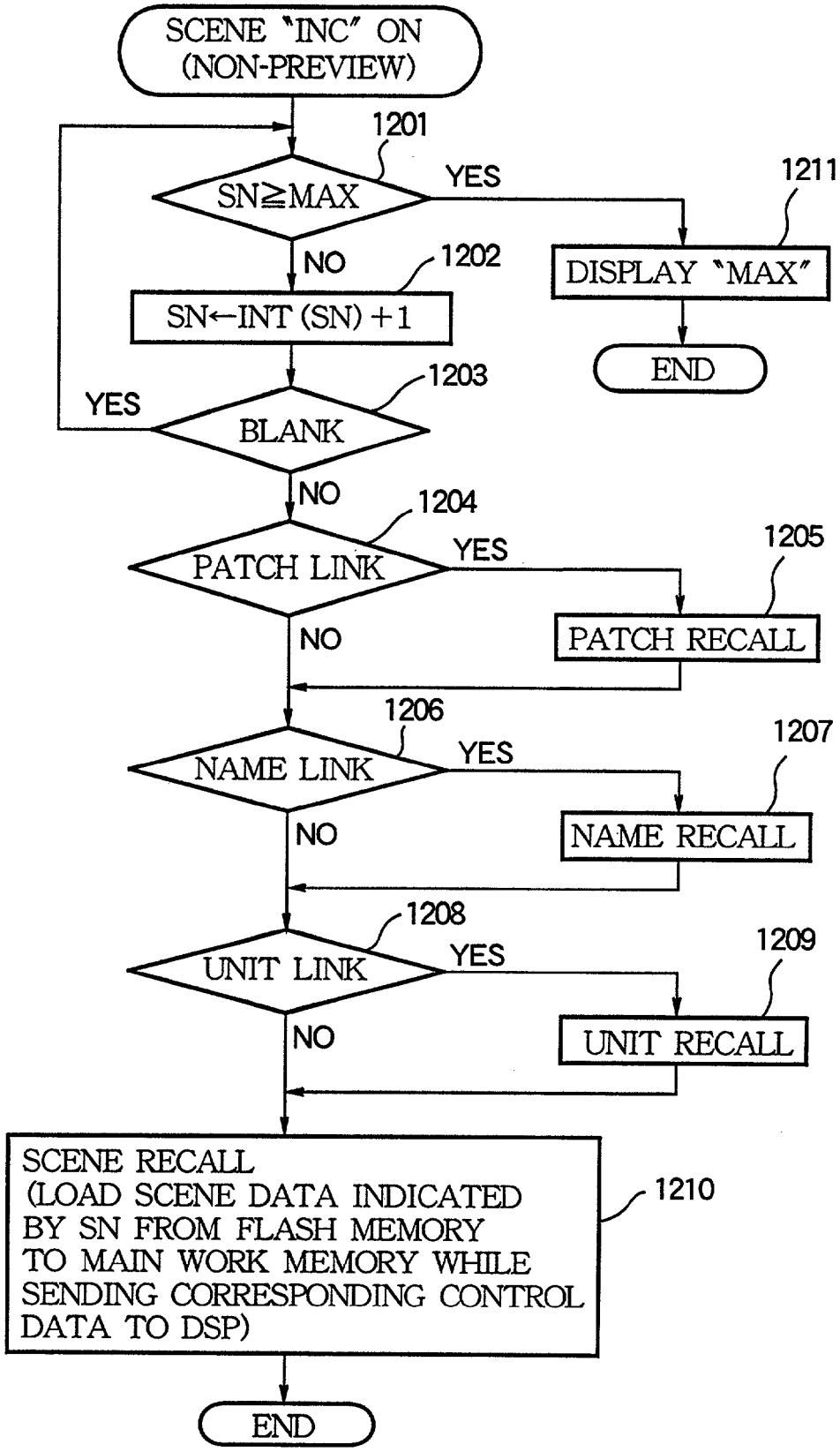
FIG. 12 is a flowchart showing a processing routine upon turning on an INC key in a non-preview mode.

FIG. 10 illustrates a common processing routine upon changing a scene number with the touch of the INC key 718 or the DEC key 719, or using the ten-key pad 717 and the recall key 714 in combination. Especially, FIG. 12 illustrates the process to increment or decrement a scene number while skipping blank scene data upon changing the scene number with the touch of the INC key 718 or the DEC key 719.

Figure 14:
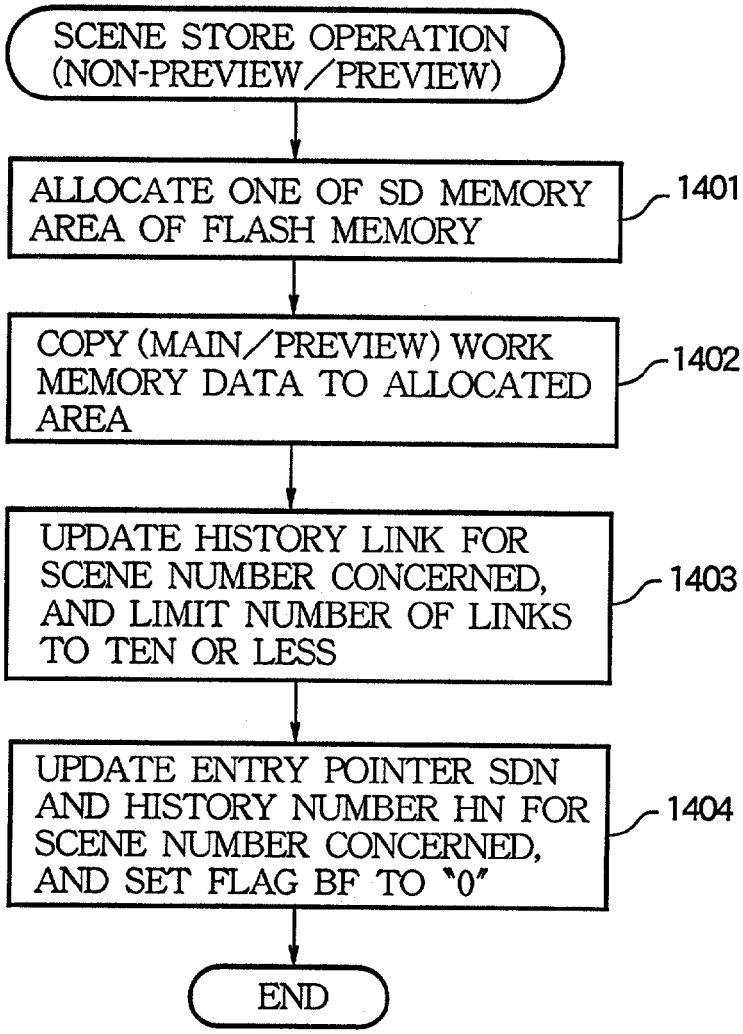
FIG. 14 is a flow chart showing a processing routine upon turning on a store switch.

As stated above in the preview mode or the non-preview mode, after any scene is recalled, various kinds of settings of the scene can be changed by operating various operators as described in FIGS. 4 to 6. Changes in setting in the preview mode have no effect on the current mixing state and the like that are now active. On the other hand, any change in setting in the non-preview mode will be directly reflected in the current mixing state and the like. Any change in setting is temporary in either the preview mode or the non-preview mode. After the setting change, data on the scene whose setting has been changed can be saved for a specified scene number by turning on the store switch 715. When the store switch 715 is turned on, a query message that inquires as for what scene number the data should be saved is displayed. In response to the query message, the user enters, on the ten-key pad 717, a scene number (only the integer part) to which the data should be allocated, and turns on the store switch 715 again, thus storing the current state of the scene in a memory area of the scene number. FIG. 14 illustrates processing upon turning on the store switch 715.

Figure 15:
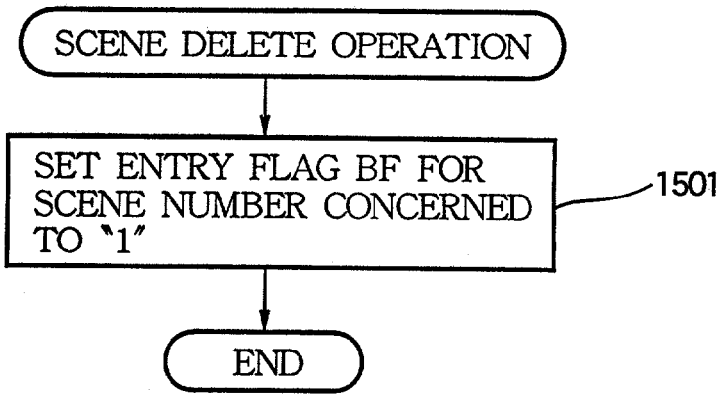
FIG. 15 is a flowchart showing a processing routine upon turning on a delete key.

The delete key 724 can be turned on to delete the scene identified by the current scene number. The data on the deleted scene, however, is still held as data indicative of the past history. In other words, a blank flag indicative of the scene deletion is just set after all. FIG. 15 illustrates processing upon turning on the delete key 724.

The cursor control key 720, the track pad 721, the left pad switch 722, and the right pad switch 723 are used when the user changes various settings while viewing a screen displayed in the display section 403 (301 in FIG. 3).

Figure 9:
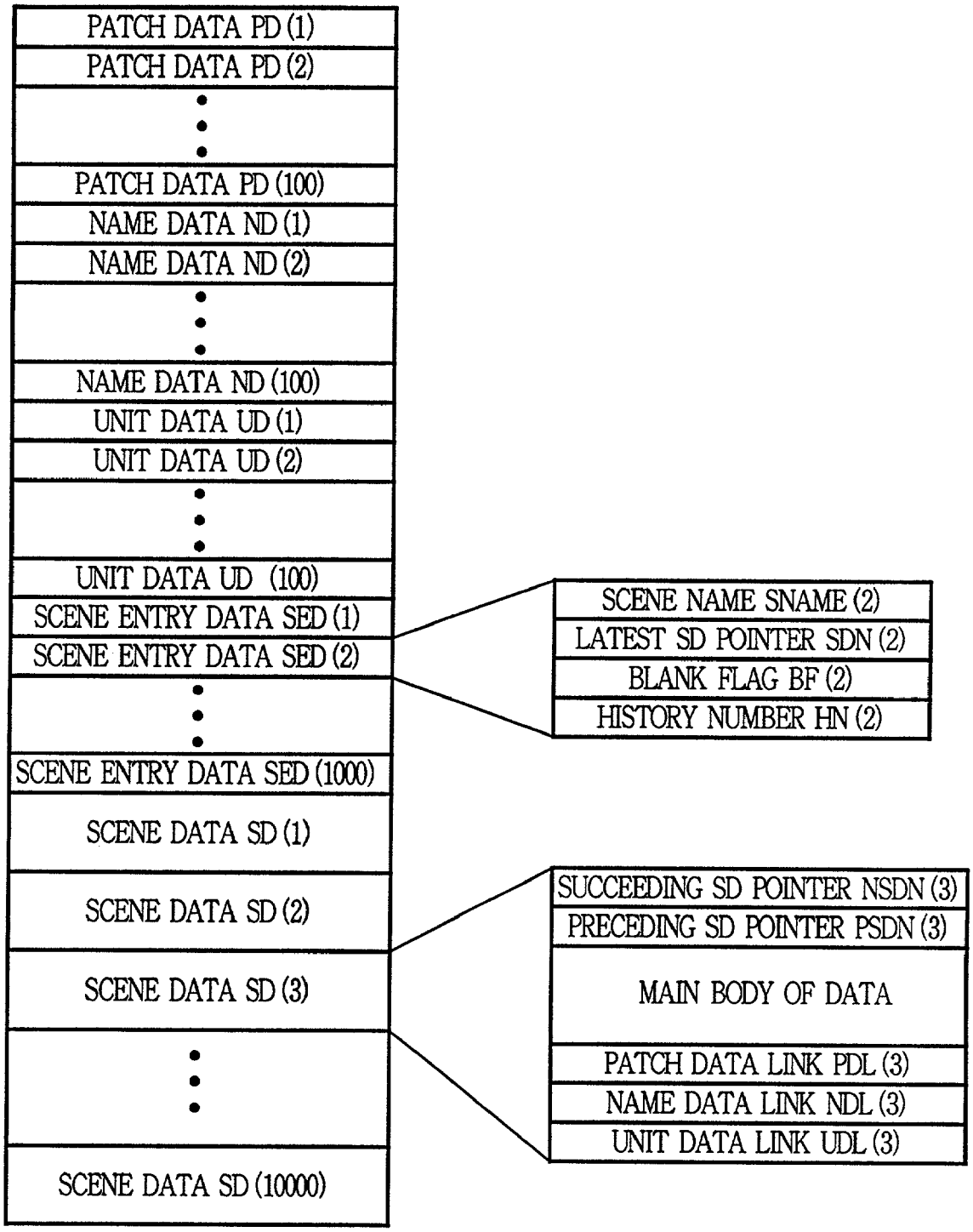
FIG. 9 is a diagram showing a memory map in a data memory area.

FIG. 9 shows a memory map of a data memory area allocated in the flash memory of FIG. 3. The data memory area contains an array of data PD(1) to PD(100) for storing 100 pieces of patch data, an array of data ND(1) to ND(100) for storing 100 pieces of name data, an array of data UD(1) to UD(100) for storing 100 pieces of unit data, an array of data SED(1) to SED(1000) for storing 1000 pieces of scene entry data, and an array of data SD(1) to SD(1000) for storing 10000 pieces of scene data.

The patch data stored in the array PD(1)-PD(100) represent connection states of the input patch 111 and the output patch 124 described in FIG. 1. The name data stored in the array ND(1)-ND(100) show correspondence between each channel of the input channel 112, the MIX output channel 122, and the matrix output channel described in FIG. 1, and names (e.g., short name) assigned to respective the channels. The unit data stored in the array UD(1)-UD(100) are setting data (e.g., gain and polarity) for each input of each input board connected to the input side interface box, and setting data (e.g., gain and polarity) for each output connected to the output side interface box.

Each of the scene entry data stored in the array SED(1)-SED(100) identifies one of the scenes registered. It should be noted that each number involved in the array corresponds to the scene number (integer part). For example, the data SED (2) corresponds to a scene with scene number "2."

As shown in FIG. 9, one scene entry data consists of a scene name SNAME, a pointer SDN that points the latest scene data SD with the scene name, a blank flag BF, and a history number HN. The scene name SNAME indicates the name of the registered scene. The scene data SD pointed by the pointer SDN is the latest version data in all the scene data of the scene concerned. The blank flag BF with a value of "0" indicates that the main body of the scene data SD pointed by the pointer SDN is valid. The blank flag BF with a value of "1" indicates that the main body of the scene data SD pointed by the pointer SDN is invalid (deleted). In the embodiment, when a scene is saved for any scene number, the saved data is held as the latest or updated scene data. In this case, if the old scene data for the scene number already exists, the old data is kept as the past version of the scene data. The history number HN indicates how many scene data including the past scene data are reserved at present. Here, one scene number (integer part) can include ten versions of the past scene data.

As shown in FIG. 9, one scene data consists of a pointer NSDN to the succeeding scene data SD in the chain of the history, a pointer PSDN to the preceding scene data SD, the main body of the scene data, a link PDL to the patch data, a link NDL to the name data, and a link UDL to the unit data.

The pointer NSDN to the succeeding scene data SD points the previous (older) scene data to the scene data concerned. The pointer PSDN to the preceding scene data SD points the subsequent (newer) scene data to the scene data concerned. Thus, all the scene data from the past to the present in the same scene number are chained by these pointers NSDN and PSDN. Since there is no scene data newer than the latest scene data in a scene number, an identifier (e.g. FF in hexadecimal) indicative of the absence of newer scene data is set in the pointer PSDN. On the other hand, there is no scene data older than the oldest scene data in the scene number, an identifier (e.g. FF in hexadecimal) is set in the pointer NSDN. The maximum value for the history number HN is ten. Suppose that when ten versions of scene data have been chained by the pointers NSDN and PSDN, new scene data is stored for the scene number. In this case, the oldest scene data is discarded.

The fraction of a scene number indicates how old the scene data is in the history of the scene number. For example, when the integer part of a scene number is 99, all the scene data SD in this scene number are identified as follows: the latest scene data has a scene number of 99.0 (the first scene data SD pointed by the pointer SDN), the previous scene data to the latest scene data has a scene number 99.1 (the second scene data SD pointed by the pointer NSDN of the first scene data SD), the scene data immediately after the second scene data has a scene number of 99.2 (the third scene data SD pointed by the pointer NSDN of the second scene data SD), and so on.

Stored in the main body field of scene data are associated to data on setting for each input channel (e.g., an effect, a fader, an output destination and its output level for each channel), data on setting for each output channel (e.g., an effect, a fader, an input source to the matrix output channel and its input level for each channel), data on setting of each internal effector, data on setting for each internal equalizer, data on setting for a monitor, and so on. Pointers are set in the link PDL field to patch data, in the link NDL field to name data, and in the link field UDL to unit data. These pointers point the patch data PD, the name data and the unit data UD used for the scene concerned, respectively.

The patch data PD, the name data ND, and the unit data UD were contained in the scene data in the conventional mixers, which were inefficient in terms of the memory capacity and response. These data are not necessarily changed for each scene, and in many cases, these settings are not changed in a sequence of plural scenes. On the other hand, there is a high possibility that the setting data included in the above-mentioned main body of scene data will be changed for each scene. The embodiment deals with this problem by providing the links PDL, NDL, and UDL in the scene data so that even if a scene is changed, a link to the same data can be maintained as long as these data are unchanged. Therefore, the memory capacity can be reduced because of no need to hold all of these data on a scene basis. In addition, when a scene is changed, the response is also faster because of no need to change the setting state as long as the data pointed by the link PDL, the NDL, or the UDL is not changed. Further, although the digital mixer has a capability of sorting the scenes based on the scene names, set values and the like, since each link is stored on a scene basis, the setting contents of each scene can never lose consistency even if the scenes are sorted.

When deletion of a scene (scene delete operation) is instructed, the blank flag BF of the scene entry data SED of the scene concerned has only to be set to "1" in a manner as will be described later. Therefore, the user can access any past scene data even on those deleted scene by following the chain from the pointer SDN of the scene entry data SED.

The setting changes in the patch data PD, the name data ND and the unit data UD can be carried out on a data setting-change screen displayed in the display section 403 through predetermined operations, by operating the ten-key 717, the cursor control keypad 720, the track pad 721, the left pad switch 722, the right pad switch 723 and the like described in FIG. 7.

FIG. 10 shows a processing routine upon changing a scene number by operating the ten-key pad 17 and the recall key 714, or the INC key 718 or the DEC key 719, as described in FIG. 7. Instep 1001, it is judged whether the present mode is the preview mode or non-preview mode. A flag PN is "1" in the preview mode or "0" in the non-preview mode. In the non-preview mode, the scene number SN is changed in step 1002 in response to the operation, and the scene data corresponding to the changed scene number SN is loaded from the data memory area of FIG. 9 to the main work memory, while sending corresponding control data to the DSP 308 so that the settings of the DSP 308 will be changed. After that, the processing is ended. If the current mode is the preview mode in the step 1001, the preview scene number PSN is changed in step 1003 in response to the operation, and the scene data corresponding to the changed preview scene number PSN is loaded from the data memory area of FIG. 9 to the main work memory. In this case, corresponding control data is not sent to the DSP.

Figure 11:
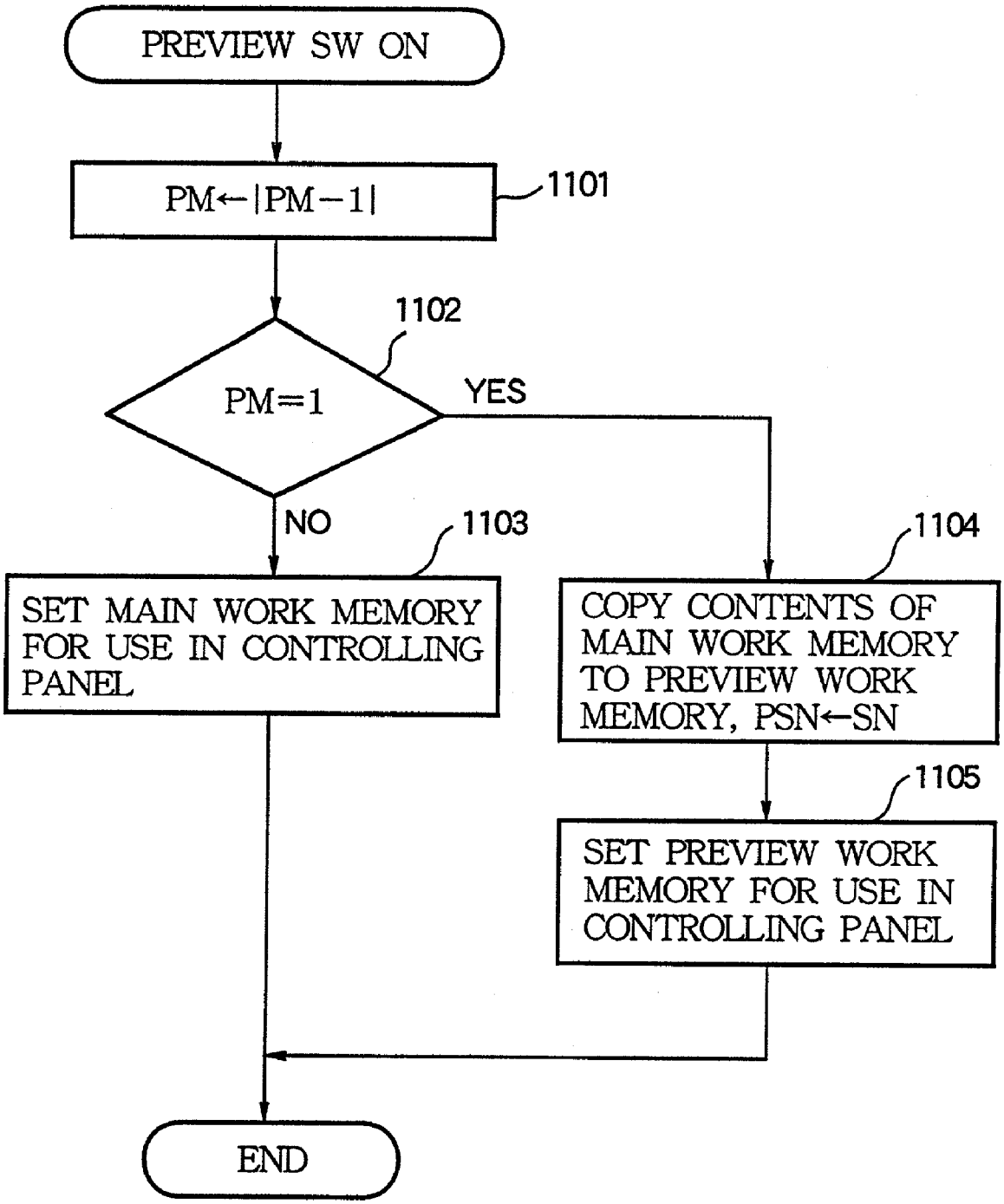
FIG. 11 is a flowchart showing a processing routine upon turning on a preview switch.

FIG. 11 shows a processing routine upon turning on the preview switch 12 of FIG. 7. In step 1101, the flag PN indicative of whether the current mode is the preview mode or non-preview mode is reversed. Next, it is judged in step 1002 whether the mode is the preview mode or non-preview mode. If it is the non-preview mode, the main work memory is set in step 1103 for use of panel control and the processing is ended. After that, data of any scene developed on the main work memory (the data being reflected in the mixer processing in the DSP) can be changed by operating various kinds of operators on the panel. If the mode is judged to be the preview mode in step 1102, the contents of the main work memory are copied in step 1104 onto a preview work memory so that the current scene number will be copied over the preview scene number PSN. Then, in step 1105, the preview work memory is set for use of panel control, and the processing is ended. After that, any setting change in the scene data on the preview work memory is made possible by operating various kinds of operators on the panel. The display contents of the display device and the positions of the operators on the panel, and the mixer processing in the DSP are controlled according to the data on the main work memory. On the other hand, the display contents of the display device and the positions of the operators on the panel are controlled according to the data on the preview work memory, but the mixer processing in the DSP is not controlled according to the data on the preview work memory.

FIG. 12 shows a processing routine upon turning on the INC key 718 of FIG. 7 in the non-preview mode. Although the general processing upon changing a scene number is described in FIG. 10, FIG. 12 is a flowchart which especially takes into account the processing for changing a scene while skipping blank scenes and the processing for following a link to recall data.

It is first judged in step 1201 whether the current scene number SN is the maximum value MAX of the scene number or greater. If SN has reached the MAX, the user is informed of the fact on the display in step 1211, and the processing is ended. On the other hand, if it is judged in step 1201 that the scene number is smaller than the maximum value MAX, value "1" is added to the scene number to create a new scene number SN in step 1202, and it is judged in step 1203 whether the scene is blank or not. Whether the scene is blank or not is found by referring to the blank flag BF of the scene entry data SED (FIG. 9) of the scene concerned. If the scene with the scene number SN is blank, the processing routine returns to step 1201.

If the target scene is not blank, the patch link PDL of the latest scene data with the scene number SN (integer part) concerned is referred to in step 1004 to determine whether the patch data is changed from the last set state (from the patch link PDL of the scene data with the scene number SN upon starting the processing), that is, whether both of patch links PDL are identical or not between the last and concerned scenes). If it is changed, the patch data PD is recalled in step 1205. Next, the name link NDL of the scene with the scene number SN is referred to in step 1206 to determine whether the name data is changed from the current set state (from the name link NDL of the last scene data). If it is changed, the name data ND of the name link is recalled in step 1207. Next, the unit link UDL of the scene with the scene number SN is referred to in step 1208 to determine whether the unit data is changed from the last set state (from the unit link UDL of the last scene data). If it is changed, the unit data of the unit link is recalled in step 1209. Finally, in step 1210, the newest version of the scene data indicated by the scene number SN (integer part) is loaded to the main work memory from the data memory area of FIG. 9 on the flash memory 305 while sending the corresponding control data to the DSP 308 to thereby end the processing.

Although, in FIG. 12, the processing upon turning on the INC key 718 in the non-preview mode is described, the processing upon turning on the DEC key 719 in the preview mode is performed in the same manner. A different point is that a scene number is changed in descending numeric order in the case where the DEC key 719 is actuated. In addition, in the preview mode, the recalled data is developed on the preview work memory rather than on the main work memory without sending the recalled data to the DSP 308.

Figure 13:
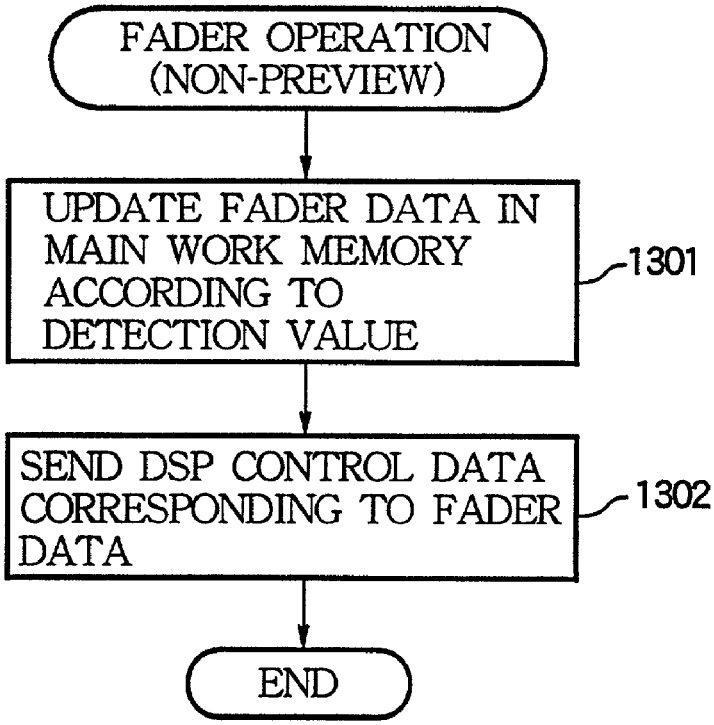
FIGS. 13(*a*) and 13(*b*) are a flowchart showing a processing routine when a fader is operated.
Figure 13:
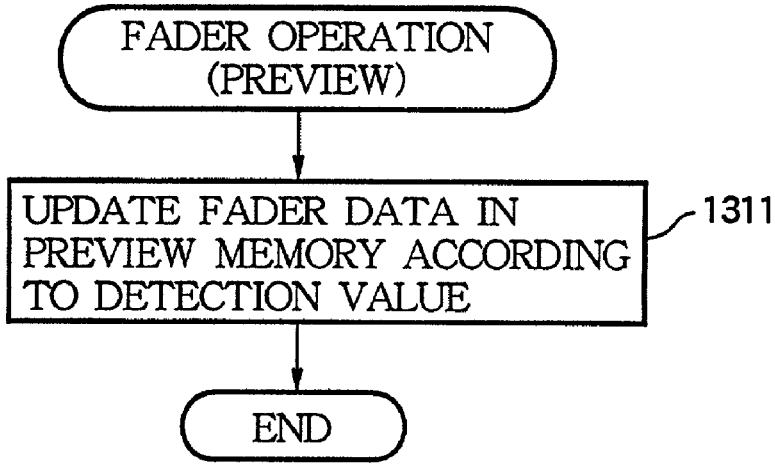

FIG. 13 shows a processing routine when a fader is operated. FIG. 13(*a*) shows the case of the non-preview mode, and FIG. 13(*b*) shows the case of the preview mode. When the fader is operated in the non-preview mode, data corresponding to the fader on the main work memory is changed in step 1301 according to a detection value of the fader. Next, in step 1302, control data corresponding to the fader concerned is sent to the DSP 308 and the processing is ended. In the preview mode, data corresponding to the fader on the preview main work memory is changed in step 1311 according to the detection value of the fader and the processing is ended. In this case, the mixer processing in the DSP 308 is not controlled in response to the operation of the concerned fader.

FIG. 14 shows a processing routine upon turning on the store switch 715 of FIG. 7. It is assumed that a scene number to be stored is specified upon starting the processing. Instep 1401, a memory area of the scene data SD is allocated into the data memory area of the flash memory in FIG. 9. In step 1402, data of the main work memory (in the non-preview mode) or the preview work memory (in the preview mode) is copied in the allocated memory area SD. In step 1403, the history link of the scene number concerned is updated (that is, the area SD concerned is placed at the top of the history link) so that the allocated memory area SD will come to the first place (as the latest scene data), while it is so controlled that the number of updated history links will be limited ten or smaller. If the number exceeds ten, the oldest scene data located at the end of the link is separated therefrom. Then, in step 1404, the entry pointer of the scene number is so updated that it will point the allocated area SD while updating the history number HN based on the number of updated history links. Further, the flag BF is set to "0" and the processing is ended.

FIG. 15 shows a processing routine upon turning on the delete key 724 of FIG. 7. In step 1501, the blank flag BF at the entry of the scene number concerned is set to "1" and the processing is ended.

Figure 16:
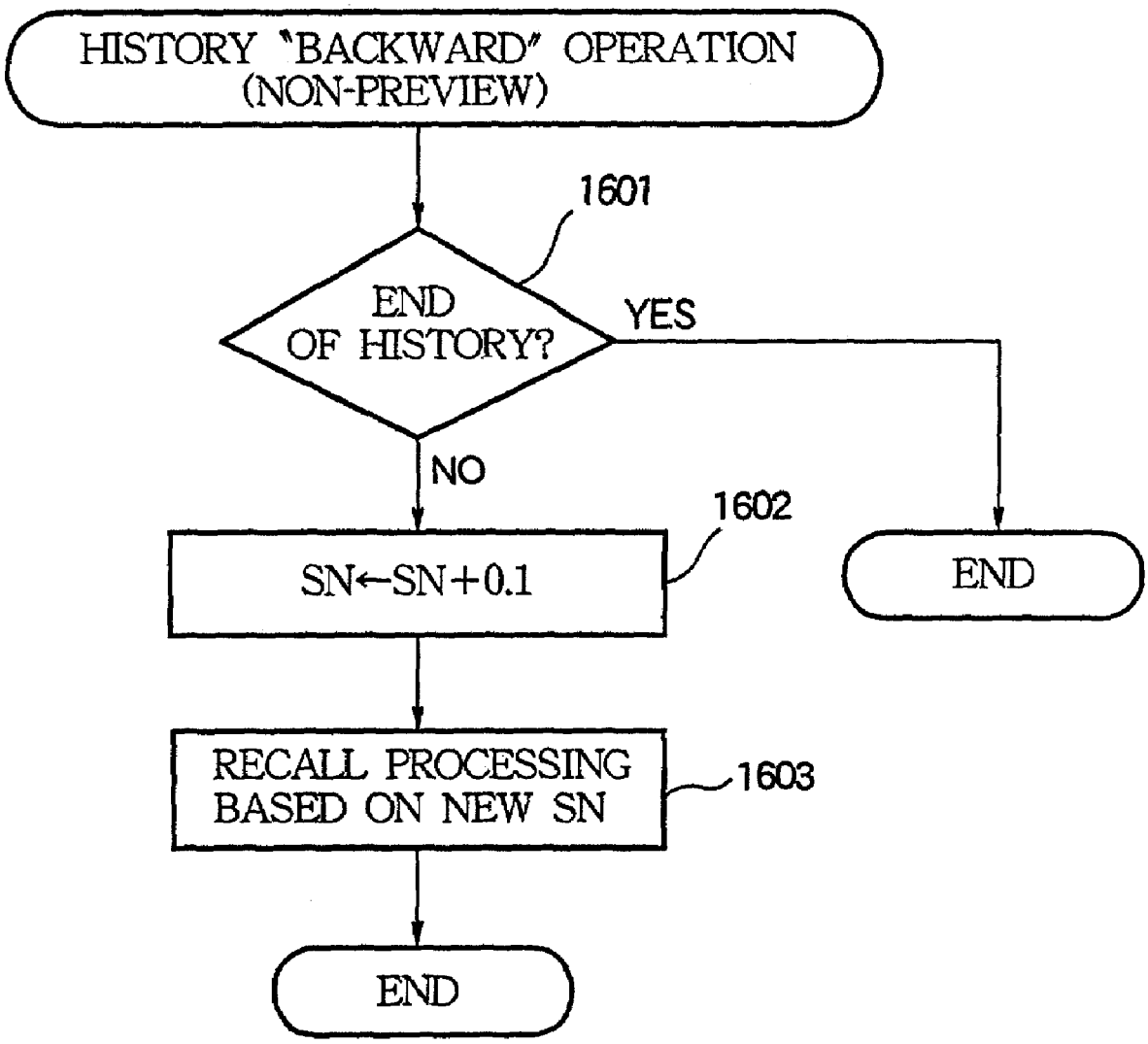
FIG. 16 is a flowchart showing a processing routine upon turning on a history "backward" switch.

FIG. 16 shows a processing routine upon turning on the history "backward" switch 713 of FIG. 7. In step 1601, it is determined whether the pointer is traced from the current scene number SN back to the end of the history (the oldest data). If the current scene is the oldest data, it is impossible to trace the history any more, hence the processing will be ended. If not the end of the history, the value "0.1" is added to the scene number in step 1602, recall processing is performed in step 1603 on a new scene number SN, and the processing is ended. It should be noted that a history "forward" switch, though not shown here, can also be used to recall data from the past version to the latest version.

In the system of the embodiment, the short names are displayed as shown at 519 of FIG. 5, 611 of FIG. 6(*a*), and 631 of FIG. 6(*b*) so that the user can easily grasp what operator or switch is assigned for control of each signal. The user can assign any short name to each channel while viewing a predetermined screen.

As described above and according to the first aspect of the invention, the preview mode and the non-preview mode are provided. In the non-preview mode, a scene with various settings related to the mixing processing can be recalled to reproduce the settings in the same manner as in the conventional system. In the preview mode, only the settings on the panel is previewed without restoration of the settings of the actual mixing processing, so that another scene can be previewed while maintaining the set state of a scene currently selected. Further, any setting can be edited in the preview mode and stored as a new scene.

According to the second aspect of the present invention, when scene data include some blank data and a scene number is incremented or decremented with an INC or DEC switch, if the scene number is blank, the increment or decrement will automatically shift to a next scene number. Therefore, a scene number can be incremented or decremented with the INC or DEC switch while skipping blank scenes (which means scenes without substantial scene data). This eliminates idle operations of the INC or DEC switch, and hence makes data manipulations simple. Further, a direct recall key can be assigned to a specific scene and operated at a break in a music event, thus easily recalling the specific scene.

According to the third aspect of the present invention, since scene data are composed of at least two-level hierarchical data, one being first level data accessible by scene identification information, and the other being second level data identified by link information contained in the first level, common use of the second level data through different scents makes it possible to reduce the memory capacity for the scene data, and hence improve response efficiency. Further, in addition to the latest scene data, past setting data are reserved as a history on a scene basis, which can respond to demands for restoring the past setting of a scene with a specific scene number. Furthermore, from the presence or absence of a change in link information before and after the recall of a scene, it can be easily judged whether to perform control based on the second level data, thereby reducing time required for switching scenes (on average).

What is claimed is:

1. A digital mixer comprising:

a mixing processor for performing a mixing process to mix audio signals fed from input channels and to feed the mixed audio signals to output channels;

a panel having a plurality of controls manipulable to operate the mixing processor and a display provided for displaying a state of the mixing processor;

a scene storage provided for storing a plurality of configuration patterns of the mixing processor as a plurality of scenes, each configuration pattern being composed of a plurality of data;

a recall command section that issues a recall command for calling one of the plurality of the scenes stored in the scene storage;

a main work memory that is provided for loading a configuration pattern, wherein the mixing processor performs the signal processing according to the configuration pattern loaded in the main work memory;

a preview work memory that is provided for loading a configuration pattern for preview;

a selector provided for selecting one of a preview mode and a non-preview mode;

a non-preview controller being operative when the non-preview mode is selected by the selector for displaying the configuration pattern loaded in the main work memory on the display, setting positions of the controls on the panel based on the configuration pattern in the main work memory, and changing the configuration pattern loaded in the main work memory in response to manipulation of the controls, and further being responsive to the recall command issued by the recall command section for reading out a configuration pattern of the scene called in response to the recall command from the scene storage and writing the read configuration pattern into the main work memory;

a preview controller being operative when the selected mode changes from the non-preview mode to the preview mode for copying the configuration pattern loaded in the main work memory to the preview work memory, and being operative when the preview mode is selected by the selector for displaying the configuration pattern loaded in the preview work memory on the display, setting positions of the controls on the panel based on the configuration pattern in the preview work memory, and changing the configuration pattern loaded in the preview work memory in response to manipulation of the controls, and further being responsive to the recall command issued by the recall command section for reading out a configuration pattern of the scene called in response to the recall command from the scene storage and writing the read configuration pattern into the preview work memory without changing a current active configuration pattern of the mixing process currently executed by the mixing processor; and a restoring section operative when the non-preview mode is again selected after the previous non-preview mode is once switched to the preview mode, for restoring again the configuration pattern on the display, which has been displayed under the previous non preview mode.

2. The digital mixer according to claim 1, further comprising a store command section that issues a store command for storing the configuration pattern loaded in either of the main work memory or the preview work memory while specifying one of the plurality of the scenes as a storing target, wherein the non-preview controller operates in response to the storing command when the non-preview mode is selected for storing the configuration pattern loaded in the main work memory into the scene specified as the storing target, and the preview controller operates in response to the storing command when the preview mode is selected for storing the configuration pattern loaded in the preview work memory into the scene specified as the storing target.

3. A digital mixer comprising:

a mixing processor configurable in matching with a scene to mix audio signals fed from input channels and to feed the mixed audio signals to output channels;

a storage provided for storing data of configuration patterns of the mixing processor in correspondence to respective scenes, the configuration patterns being associated with scene numbers corresponding to the respective scenes, data of one scene containing not only a current version of the configuration pattern but also one or more past version of the configuration pattern of the same scene, respective versions of the configuration pattern being associated with version numbers, further data of each configuration pattern containing a blank flag which is set or reset for indicating whether the configuration pattern is blank or not;

a data writing section that selects one of the scene numbers, and that writes data of a current configuration state of the mixing processor into the storage as the configuration pattern of the selected scene number, and that resets the blank flag of the written configuration pattern if the blank flag has been set;

an operator panel including a switch operable to successively increment or decrement the scene numbers to call one scene as desired, and a set of keys operable to input a scene number and a version number to call one version of one scene;

a data erasing section that selects one of the scene numbers and that sets the blank flag of the selected scene number to indicate that the corresponding configuration pattern is blank;

a first data reading section that reads out data of the configuration pattern corresponding to the called scene from the storage so that the mixing processor can be configured according to the current version of the read configuration pattern to produce the corresponding scene;

a second data reading section that reads out the called version of the called configuration pattern from the storage when the switch or the keys is operated to input the scene number and the version number, so that the mixing processor can be configured according to the read version of the configuration pattern to produce the corresponding scene; and a controller operative during the course of operating the switch for skipping any scene number if the associated configuration pattern is indicated blank by the blank flag even when the associated configuration pattern has the past version, while the remaining scene numbers are successively incremented or decremented.

4. A digital mixer comprising:

a mixing circuitry configurable based on a configuration pattern for mixing audio signals fed from input channels and feeding the mixed audio signals to output channels;

a storage provided for storing data of configuration patterns in correspondence to respective scenes such that one configuration pattern could be selected corresponding to one scene, the data of one scene containing not only a current version of the configuration pattern but also one or more past version of the configuration pattern of the same scene, wherein the respective scenes have their own current and past versions of the corresponding configuration patterns, the respective versions of one scene being identified by a scene number corresponding to the scene and by version numbers corresponding to the respective versions;

a data writing section that selects one of the scenes stored in the storage, and that writes data of a configuration state of the mixing circuit into the storage as the configuration pattern of the selected scene, such that the selected scene contains not only the current version of the configuration pattern which is lastly written by the data writing section but also one or more of the past version of the configuration pattern of the same scene which has been previously written by the data writing section;

an operator panel operable for selectively calling one of the scenes as desired; and a data reading section that reads out the data of the configuration pattern corresponding to the called scene from the storage, and that configures the mixing circuitry based on the read configuration pattern, wherein the data reading section can selectively perform either of configuring the mixing circuitry based on the current version of the read configuration pattern or configuring the mixing circuitry based on the past version of the read configuration pattern.

5. The digital mixer according to claim 4, wherein the storage stores the configuration patterns in association with identification codes, each being comprised of a main code and a sub code corresponding to the version number such that the current version of the configuration pattern is identified by the main code corresponding to the scene and the past version of the same configuration pattern is identified by the sub code, and wherein the data reading section operates when the operator panel inputs only the main code for reading the current version of the configuration pattern identified by the inputted main code, and operates when the operator panel inputs the sub code together with the main code for reading the past version identified by the inputted sub code from the configuration pattern identified by the inputted main code.

6. The digital mixer according to claim 5, wherein the identification code comprises a number having an integer part defining the main code and a fixed size fractional part defining the sub code.

* * * * *